United States Patent [19]

Slothour et al.

[11] Patent Number: 4,580,860

[45] Date of Patent: Apr. 8, 1986

[54] DEVICE FOR ADVANCING AND RETRACTING SINGLE OR MULTIPLE ELECTRICAL CONNECTOR HALVES IN AN ELECTRICAL CONNECTOR

[75] Inventors: Donald L. Slothour, Wilmington; Roger S. Kauffman, Newark, both of Del.

[73] Assignee: W. L. Gore & Associates, Inc., Newark, Del.

[21] Appl. No.: 468,935

[22] Filed: Feb. 23, 1983

[51] Int. Cl.[4] ..... H01R 13/74

[52] U.S. Cl. ..... 339/34; 339/64 M; 339/129

[58] Field of Search ..... 339/34, 64 R, 64 M, 339/129, 130 R, 130 C, 75 R, 75 M, 125 R, 126 R

[56] References Cited

U.S. PATENT DOCUMENTS

| | | | |
|---|---|---|---|
| 2,719,279 | 9/1955 | Muckler | 339/177 R |
| 2,808,575 | 10/1957 | Karlson | 339/92 M |
| 2,847,652 | 8/1958 | Kokalas | 339/75 M |
| 3,017,597 | 1/1962 | Nava et al. | 339/64 M |
| 3,094,364 | 6/1963 | Lingg | 339/64 M |
| 3,173,734 | 3/1965 | Hartwell | 339/49 R |
| 3,368,040 | 2/1968 | Bryan | 179/5 R |
| 3,495,206 | 2/1970 | Pfister | 339/64 R |
| 3,597,711 | 1/1969 | Buckley | 339/64 R |
| 3,629,791 | 12/1971 | Normann | 339/45 M |
| 3,701,083 | 10/1972 | Ziegler, Jr. | 339/64 M |
| 3,883,209 | 5/1975 | Kongelbeck | 339/125 R |
| 3,951,500 | 4/1976 | Anderson | 339/64 M |
| 3,966,291 | 6/1976 | Hug | 339/64 R |
| 4,030,797 | 6/1977 | Nieman | 339/64 M |

FOREIGN PATENT DOCUMENTS

| | | | |
|---|---|---|---|
| 0381178 | 9/1932 | United Kingdom | 339/64 R |
| 1228743 | 4/1971 | United Kingdom | 339/130 C |

*Primary Examiner*—Gil Weidenfeld
*Assistant Examiner*—Thomas M. Kline
*Attorney, Agent, or Firm*—Finnegan, Henderson, Farabow, Garrett & Dunner

[57] ABSTRACT

An electrical connection device for advancing single or multiple first connector halves into positive engagement with substantially aligned second connector halves wherein at least the connections for the first connector halves are inserted through a panel. The first connector halves are mounted in one end of a barrel which can be axially moved inwardly and outwardly through an aperture in the panel. A rotatable, but axially fixed, nut is mounted on the panel around the aperture and threadably engages the surface of the barrel. A fixed sleeve extends outwardly from the panel on the opposite side from the connector halves for additional support of the retracted barrel and at least one keyway in the sleeve receives a key extending radially from the barrel to prevent rotation of the barrel.

14 Claims, 5 Drawing Figures

DEVICE FOR ADVANCING AND RETRACTING SINGLE OR MULTIPLE ELECTRICAL CONNECTOR HALVES IN AN ELECTRICAL CONNECTOR

BACKGROUND OF THE INVENTION

1. Field of the Invention

The present invention relates to a device for connecting multiple electrical cables and more particularly to a device of this type that is capable of advancing or retracting multiple electrical connector halves through an equipment panel for connection to complementary connector halves. The present invention finds particular utility in facilitating the mating or unmating of electrical connectors in situations where space limitations will not permit access to the connectors for utilization of conventional means of mating and unmating the connectors.

2. Description of the Prior Art

The term "electrical conector" connotes virtually any device for connecting the end of a wire to a similar device or to a mating part. Coaxial, pin and socket, rack and panel, and a variety of other connector types are well known in the art. In particular, one set of connector halves may be inserted through an opening in a panel and secured thereto. A second set of connector halves may then be positioned in axial alignment with the first connector halves and moved relatively towards the first connector halves until the connectors engage each other. The connector parts must be precisely positioned and manufactured to a very high degree of dimensional tolerance to assure axial alignment of the connectors.

Such a device, as described in U.S. Pat. No. 3,094,364, embodies first connector halves having a spring-loaded mounting, a radially extending collar, and guide pins. As the second connector halves are brought into contact with the first connector halves, the first connector body can be displaced obliquely of its axial alignment to some extent so that, if the mating connector is moved into engagement with the first connector body having the above-described mounting arrangement, the first connector body can realign itself relative to the panel until the connector halves are in axial alignment.

Complementary electrical connector halves placed in axial alignment can quickly be engaged and disengaged by mechanical means, as described in U.S. Pat. No. 3,629,791. In this device lever-actuated means selectively lock the linearly movable connector halves in advanced connector assembled position and retracted connector parts in disassembled position.

One of the problems associated with rack and panel connectors has been achieving proper alignment of the two connector members prior to the coupling action, as illustrated in U.S. Pat. No. 3,951,500, wherein the circular panel connector has guide pins and a spring-loaded, rack-mounted first connector receptacle to facilitate the alignment and the mating of a panel-mounted connector with the rack-mounted receptacle.

Four basic directions of connector misalignment must be considered: (1) radial, (2) axial, (3) rotational, and (4) angular. As explained in U.S. Pat. No. 4,030,797, three of these conditions can be accounted for without serious complications, but the four in combination pose a difficult problem. While connector design could compensate for two or three of these conditions, the fourth condition was formerly met through structural design. The solution proffered in U.S. Pat. No. 4,030,797 utilizes a tube-like plug shell and an apparatus for mounting the plug shell in a housing. The plug shell is capable of moving relative to the housing in substantially an infinite number of paths to accommodate mating of the electrical parts in locations of moderate or extreme inaccessibility in spite of any preliminary misalignment.

In the mating of electrical connectors, a common technique is to substantially align the connector halves and to move the connector halves relatively towards each other until they have engaged. The requisite relative motion of the connector halves toward each other in mating, or away from each other in unmating, is commonly accomplished by moving the panels on which the connector halves are mounted relatively toward or away from each other.

An annular connector method such as the lever-actuated device of U.S. Pat. No. 3,629,791, referred to above, may be employed for such purposes. Similarly, the electrical connector can be designed to compensate for axial separation of the mounting surfaces as taught in U.S. Pat. No. 4,030,797, also previously referred to.

The problem inherent in these types of electrical connector mounting arrangements is that some equipment configurations may impose space limitations that will not permit sufficient access to electrical connectors which are ordinarily rigid in construction, for employment of conventional means of mating or unmating. Alternatively, equipment configurations may require spacing between panels that will not permit full engagement of conventional electrical connector types.

Thus, if electrical connectors which are to be engaged are positioned prior to engagement so that the space between fixed panels upon which the connectors are mounted is too limited for fitting and adjustment of conventional connector halves, positive engagement of the connectors may not be insured. This situation in the past required the use of special connectors precisely dimensioned for the equipment panel spacing. Alternatively, a desired equipment configuration may need to be modified in order to enable positive engagement of conventional connectors.

SUMMARY OF THE INVENTION

An object of the invention, therefore, is the provision of electrical connectors which can be precisely mated and unmated where space will not permit sufficient access for employment of conventional methods.

An additional object of the invention is to provide an electrical connector in which the connector halves can be separated to a recessed state, without interfering with other electronic equipment.

Additional objects and advantages of the invention will be set forth in part from the description which follows and in part will be obvious from the description, or may be learned by practice of the invention. The objects and advantages of the invention may be realized and attained by means of the instrumentalities and combinations particularly pointed out in the appended claims.

To achieve the objects, and in accordance with the purposes of the invention, as embodied and broadly described herein, the electrical connector of the invention comprises a device for advancing and retracting one or more first connector halves in a panel to facilitate mating and unmating with corresponding substantially aligned second connector halves, including a connector-mounting barrel, means for mounting the first electrical connector halves on the outer end of the barrel, means for mounting the barrel in an aperture in the panel, the mounting means permitting axial movement of the barrel through the panel, means for advancing the barrel through the panel for positive mating of the first connector halves with the second electrical connector halves and for retracting the barrel through the panel, and means for preventing rotation of the barrel relative to the panel during such advancing and retracting.

The connector-mounting barrel of the invention, as illustrated, has a threaded outer surface which can be engaged by the means for advancing the barrel through a panel for positive mating with the second electrical connector halves and for retracting the barrel through the panel and the device includes one or more electrical connector halves affixed to an end of the barrel, a plate for mounting the barrel in an aperture in the panel, the plate including means for fastening the plate to the panel and a flange portion surrounding an aperture in the plate, the plate aperture being aligned with the aperture in the panel for receiving the barrel, an axially fixed nut rotatably mounted on the flange and threadably engaging the outer surface of the barrel for advancing the barrel through the panel for positive mating with the second electrical connector halves and for retracting the barrel through the panel, support means integral with the plate for providing additional support to the barrel, and keyway means cooperating between the barrel and the support means for preventing rotation of the barrel relative to the panel.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
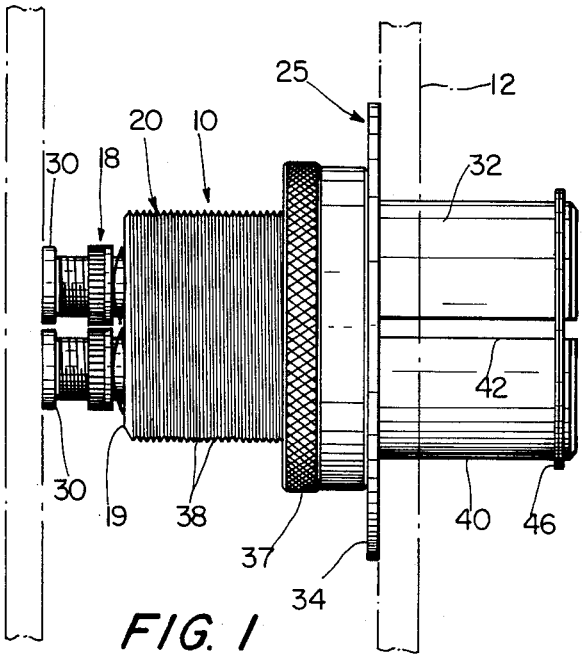
FIG. 1 is a side view of the connector of the invention as mounted on a pair of parallel panels and in the advanced position.
Figure 2:
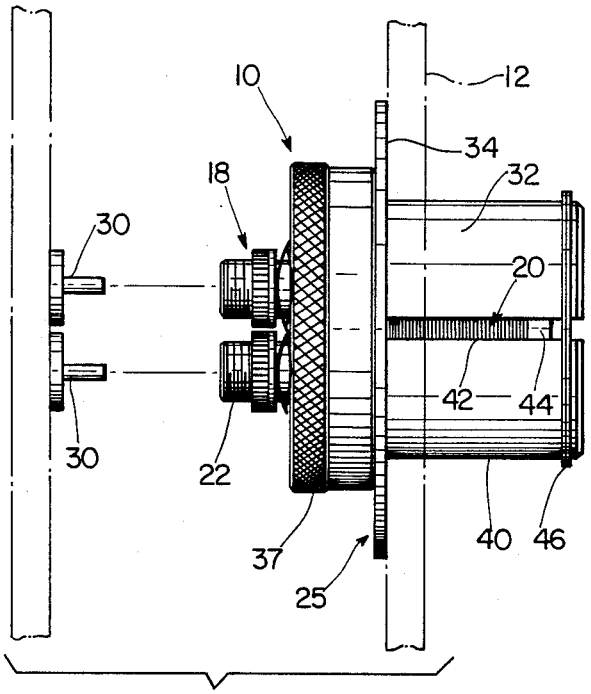
FIG. 2 is a side view of the connector of FIG. 1 in retracted position.

The preferred embodiment of the connector device of the invention for advancing and retracting single or multiple electrical connectors is shown in FIG. 1, in the advanced position, and in FIG. 2 in the retracted position, and is represented generally by the numeral 10. This device includes a connector-mounting barrel represented generally by the numeral 20. As embodied herein, the outer surface of the connector-mounted barrel is threaded.

Figure 3:
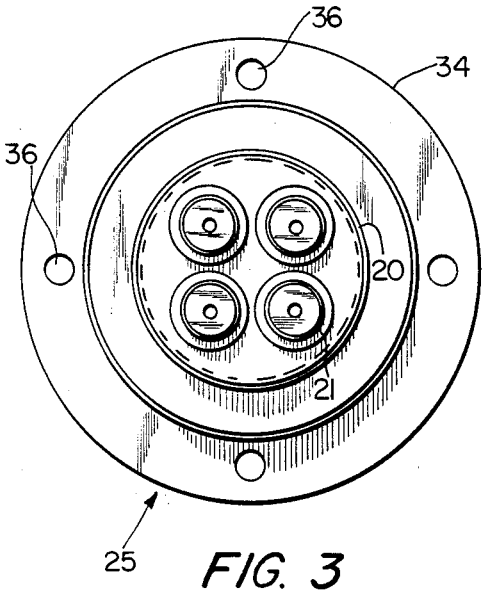
FIG. 3 is a plan view of first connector half of the connector of FIG. 1.
Figure 4:
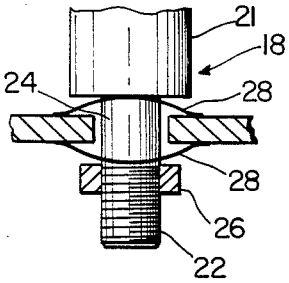
FIG. 4 is a detailed view of the mounting of a first connector half of the connector of FIG. 1.

The connector device of the invention includes means for mounting first connector halves on the outer end of the barrel 20. Preferably, the mounting means for the first connector halves numbered generally as 18, includes radially free-floating and axially spring-loaded electrical connector mountings, as shown in FIG. 4. Each of the first connector halves 18 has a cup-shaped receptacle 21 within the barrel 20 (FIG. 3) and a female connector portion 22 extending outwardly through an aperture 24 in the outer end 19 of the barrel. The outer end of the female connector portion 22 is threaded for receiving a nut 26. An annular leaf spring 28 is positioned on each side of the aperture 24, the portion 22 of the female connector extending through the annular springs.

The diameter of the aperture 24 is sufficiently larger than the diameter of the female connector portion 22 to allow the female connector portion to be radially free-floating. As a result, when the nut 26 is properly tightened against the outer leaf spring 28, the first connector half 18, which is a female connector portion as illustrated, is axially spring-loaded and radially free-floating in the end 19 of the barrel 20. It is apparent that the first connector half could be a male connector portion of a connector, if desired.

As shown in FIGS. 1 and 2, second electrical halves 30 are substantially aligned with the first electrical halves 18. As illustrated, the second connector halves 30 are mounted on a panel in parallel with the panel bearing the connector-mounting barrel 20. As described hereinafter in more detail, this situation, in which the locations of the panels are fixed, presents problems which this invention is peculiarly adapted to solve.

As the barrel 20 is advanced by structure described in detail with further reference to FIGS. 1 and 2, the first connector halves 18 approach the substantially aligned second connector halves 30. If the individual connector halves 18, 30 are not precisely aligned, the radially free-floating mounting of the first connector halves allows the connector halves to make precise connection. As the corresponding connector halves are brought closely into connection, the first connector halves, axially biased by the springs 28, insure positive pressure engagement. If desired, the inner edges of the terminal portions of the first connector halves 18 may be beveled to facilitate meshing the first and second connector halves.

With additional reference now to FIG. 1, there is shown a side view of the preferred embodiment of the means of the invention for mounting the connector-mounting barrel 20 in an aperture 32 in the first equipment panel 12. As embodied herein, the mounting means includes a mounting plate 25 which permits axial movement of the connector-mounting barrel 20 through the panel 12. With reference also to FIG. 3, the mounting plate of the invention has a flange 34 whereby the mounting plate 25 can be attached to the first equipment panel 12 by ordinary fastening means such as screws or bolts through apertures 36. The mounting plate 25 is positioned so that the flange 34 surrounds the aperture 32 in the first equipment panel 12. The connector device of the invention also includes means for advancing the barrel through the panel for positive mating of the first connector halves with the second connector halves and for retracting the barrel through the panel. As embodied herein, the means for advancing and retracting the barrel 20 includes an axially fixed nut 37 rotatably mounted on the flange 34 and threadably engaging the outer surface of the barrel 20.

The threaded nut 37 may be rotatably mounted on the flange 34 by any known means such as a groove in the mounting plate 25 and a retaining ring as long as the nut is fixed against axial movement.

The outer surface of the barrel 20 bears threads 38 for interacting with the rotation of the nut 37 for advancing the connector-mounting barrel 20 through the equipment panel 12 for positive mating of the first connector halves 18 with the second connector halves 30 and for retracting the connector-mounting barrel 20 through equipment panel 12.

The preferred embodiment of the invention also includes support means integral with the mounting plate for providing additional support for the barrel. As embodied herein, the support means includes a support sleeve 40 integrally mounted on the flange 34 of the mounting plate 25. The support sleeve 40 preferably is positioned on the side of the first equipment panel 12 opposite the mounting plate 25 and serves to provide additional support to the connector-mounting barrel 20. As the barrel 20 is retracted through the equipment panel 12, the barrel is received in nearly its full length by the sleeve 40. The support sleeve 40 includes at least one keyway 42 which cooperates with a key or tang 44 on the connector-mounting barrel 20 to prevent rotation of the connector-mounting barrel relative to the equipment panel 12.

Although only one keyway 42 and key 44 are shown, it may be desirable to have two or more keyways with cooperating keys to support the barrel 20 properly and to maintain the barrel 20 against any rotation with respect to the panel 12.

It may be found desirable to place a non-expansible ring 46 around the outer end of the sleeve 40 to prevent any tendency of portions of the sleeve, as divided by the keyways 42, from spreading apart. Maximum support for the barrel 20 is thus maintained. The ring 46, of course, must not interfere with the movement of the key 44 in the keyway 42. It is preferred, therefore, that the key 44 not extend radially beyond the outer surface of the sleeve 40.

It is preferred that the barrel 20, sleeve 40 and nut 37 be structured, dimensioned and positioned for retracting the barrel so as to provide maximum clearance between the first connector halves and the inner surface of the second panel. This purpose is accomplished in the preferred embodiment wherein the rotating nut 37 is positioned on the opposite side of the panel from the extending portion of the sleeve, giving maximum housing length for the retracting barrel and first connector halves.

Figure 5:
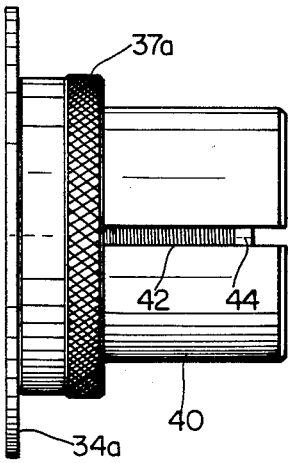
FIG. 5 is a second embodiment of the barrel mounting means of the invention.

For some uses of the invention, it may be desirable to locate the mounting plate and the extending portion of the sleeve both on the side of the equipment panel opposite to the connection halves, as shown in FIG. 5. Such an embodiment of the invention works perfectly satisfactorily, but may entail a longer sleeve 40. On the other hand, the rotating nut 37*a* is more accessible and the flange 34*a* can be more readily attached to the equipment panel 12.

As mentioned heretofore, the connection device of the invention has many uses, but is of particular utility where access to the connector halves is limited. In situations where connector halves must be joined between panels and the voltage requires relatively bulky elements, the connector halves must be exactly aligned and pressed into positive engagement. The connector device of the invention solves the problem when conventional equipment cannot get access to the elements for positive connection.

Additionally, the connection device of the invention permits the connection halves to be separated and the first connection halves completely withdrawn from the area between the panels to have access to the area for other purposes.

It will be apparent to those skilled in the art that various modifications and variations can be made in the device for advancing and retracting single and multiple electrical connectors halves of the present invention without departing from the scope or spirit of the invention. Thus, it is intended that the present invention cover the modifications and variations of this invention provided they come within the scope of the appended claims and their equivalents.

What is claimed is:

1. A connector device for advancing and retracting one or more first electrical connector halves in a panel to facilitate mating and connecting said first electrical connector halves with corresponding substantially aligned second electrical connector halves without further movement of said panel or of said second electrical connector halves, said device comprising:

a connector-mounting barrel;

means for mounting said first electrical connector halves on an outer end of said barrel;

means for mounting said barrel in an aperture in said panel and permitting axial movement of said barrel through said panel, said barrel mounting means including a flange portion surrounding said aperture;

means for advancing said barrel through said panel for positive mating of said first electrical connector halves with said second electrical connector halves and for retracting said barrel through said panel, said means for advancing and retracting said barrel including an axially fixed nut rotatably mounted on said flange portion and threadably engaging the outer surface of said barrel; and means for preventing rotation of said barrel relative to said panel during such advancing and retracting.

2. The device of claim 1 wherein said means for mounting said first electrical connector halves includes radially free-floating and axially spring-loaded electrical connector mountings.

3. The device of claim 1 wherein said barrel mounting means includes a plate and means for fastening said plate to said panel, said plate including said flange portion.

4. The device of any one of claims 1, 2, or 3 wherein said means for preventing rotation includes keyway means.

5. The device of claim 1, further comprising a sleeve integrally mounted on said flange portion for receiving said barrel as said barrel is retracted, said sleeve including at least one longitudinally extending slot parallel to the axis of said barrel, and wherein said barrel includes a tang extending radially and individually into each of said slots.

6. The device of claim 5 wherein said flange portion and said nut are positioned on the wall of said panel facing said second electrical connector halves, and said sleeve extends through said panel.

7. The device of claim 5 wherein said barrel, sleeve, and nut are proportioned for permitting said first electrical connector halves to be recessed substantially into said nut when said barrel is retracted.

8. A device for mounting one or more first electrical connector halves on a first panel to facilitate mating said first electrical connector halves with corresponding substantially aligned second electrical connector halves positioned on a second panel without further movement of said first or second panels, said device comprising:

a connector-mounting barrel;

one or more first electrical connector halves mounted on an outer end of said barrel;

a plate for mounting said barrel in an aperture in said first panel, said plate including means for fastening said plate to said first panel and a flange portion surrounding an aperture in said plate, said plate aperture being aligned with said aperture in said first panel for receiving said barrel;

an axially fixed nut, rotatably mounted on said flange portion and threadably engaging the outer surface of said barrel, for advancing said barrel through said first panel for positive mating with said second electrical connector halves and for retracting said barrel into said first panel;

support means integral with said plate for providing additional support for said barrel; and keyway means cooperating between said barrel and said support means for preventing rotation of said barrel relative to said first panel.

9. The device of claim 8 wherein said first electrical connector halves are radially free-floating and axially spring-loaded.

10. The device of claim 8 wherein said support means includes a cylindrical sleeve surrounding said barrel.

11. The device of claim 10 wherein said keyway means includes an axially extending slot in said sleeve and a key formed on the exterior wall of said barrel for cooperating with said slot.

12. The device of claim 10 or 11 wherein said barrel, nut, and sleeve are structured for retracting said first electrical connector halves substantially into said nut for providing maximum clearance between said first electrical connector halves and said second panel.

13. The device of claim 8 wherein said first electrical connector halves are radially free-floating and axially spring-loaded; said support means includes a cylindrical sleeve surrounding said barrel; said keyway means includes an axially extending slot in said sleeve and a key formed on the exterior surface of said barrel for cooperating with said slot; and said barrel, sleeve, and nut are positioned and dimensioned for retracting said first electrical connector halves substantially into said nut for providing a maximum clearance between said first electrical connector halves and said second panel.

14. A connector device for advancing and retracting one or more first electrical connector halves in a panel to facilitate mating and connecting said first electrical connector halves with corresponding substantially aligned second electrical connector halves without further movement of said panel or said second electrical connector halves, said device comprising:

a. a connector-mounting barrel;

b. radially free-floating and axially spring-loaded electrical connector mountings for mounting said first electrical connector halves on an outer end of said barrel;

c. a plate for mounting said barrel in an aperture in said panel, said plate including means for fastening said plate to said panel and a flange portion surrounding an aperture in said plate, said plate aperture being aligned with said panel aperture for receiving said barrel;

d. an axially fixed nut, rotatably mounted on said flange portion and threadably engaging the outer surface of said barrel, for advancing said barrel through said panel for positive mating of said first electrical connector halves with said second electrical connector halves and for retracting said barrel into said panel;

e. a sleeve integrally mounted on said flange portion for receiving said barrel as said barrel is retracted, said sleeve including at least one longitudinally extending slot parallel to the axis of said barrel; and f. a tang formed on the exterior wall of said barrel and extending radially from said barrel for cooperating with said slot.

* * * * *